United States Patent [19]

Updike et al.

[11] 4,314,702

[45] Feb. 9, 1982

[54] PORTABLE FOLDING INDOOR-OUTDOOR HORSESHOE COURT

[76] Inventors: Harold K. Updike, 946 E. 6th St.; Kenneth N. Updike, 1737 E. 5th St., both of Fremont, Nebr. 68025

[21] Appl. No.: 121,930

[22] Filed: Feb. 15, 1980

[51] Int. Cl.[3] ..... A63B 67/00

[52] U.S. Cl. ..... 273/336

[58] Field of Search ..... 273/336, 337, 338, 339

[56] References Cited

U.S. PATENT DOCUMENTS

| | | | |
|---|---|---|---|
| 1,543,767 | 6/1925 | Heggen | 273/336 |
| 2,476,532 | 7/1949 | Bouchard | 273/336 |
| 3,356,368 | 12/1967 | Dixon | 273/336 |
| 3,547,442 | 12/1970 | Fenicchia | 273/336 |

*Primary Examiner*—William H. Grieb

*Attorney, Agent, or Firm*—Zarley, McKee, Thomte, Voorhees & Sease

[57] ABSTRACT

A portable horseshoe court is disclosed comprising a horizontally disposed frame having forward and rearward ends and opposite sides. A first pitcher's platform is positioned on the frame adjacent one side thereof and extends between the forward and rearward ends thereof. A second pitcher's platform is provided on the frame adjacent the other sides thereof which also extends between the forward and rearward ends thereof. A pan is positioned on the frame between the platforms and is capable of containing or receiving dirt therein. A stake is secured to the pan and extends upwardly from the pan equi-distantly between the platforms. A normally upstanding backstop has its lower end pivotally connected to the rearward end of the frame whereby the backstop may be selectively pivoted from its normal upstanding position behind the frame to a substantially horizontal transport position extending over the platforms and the pan. When the backstop is folded downwardly to its transport position, the entire court may be easily transported to a different location.

5 Claims, 4 Drawing Figures

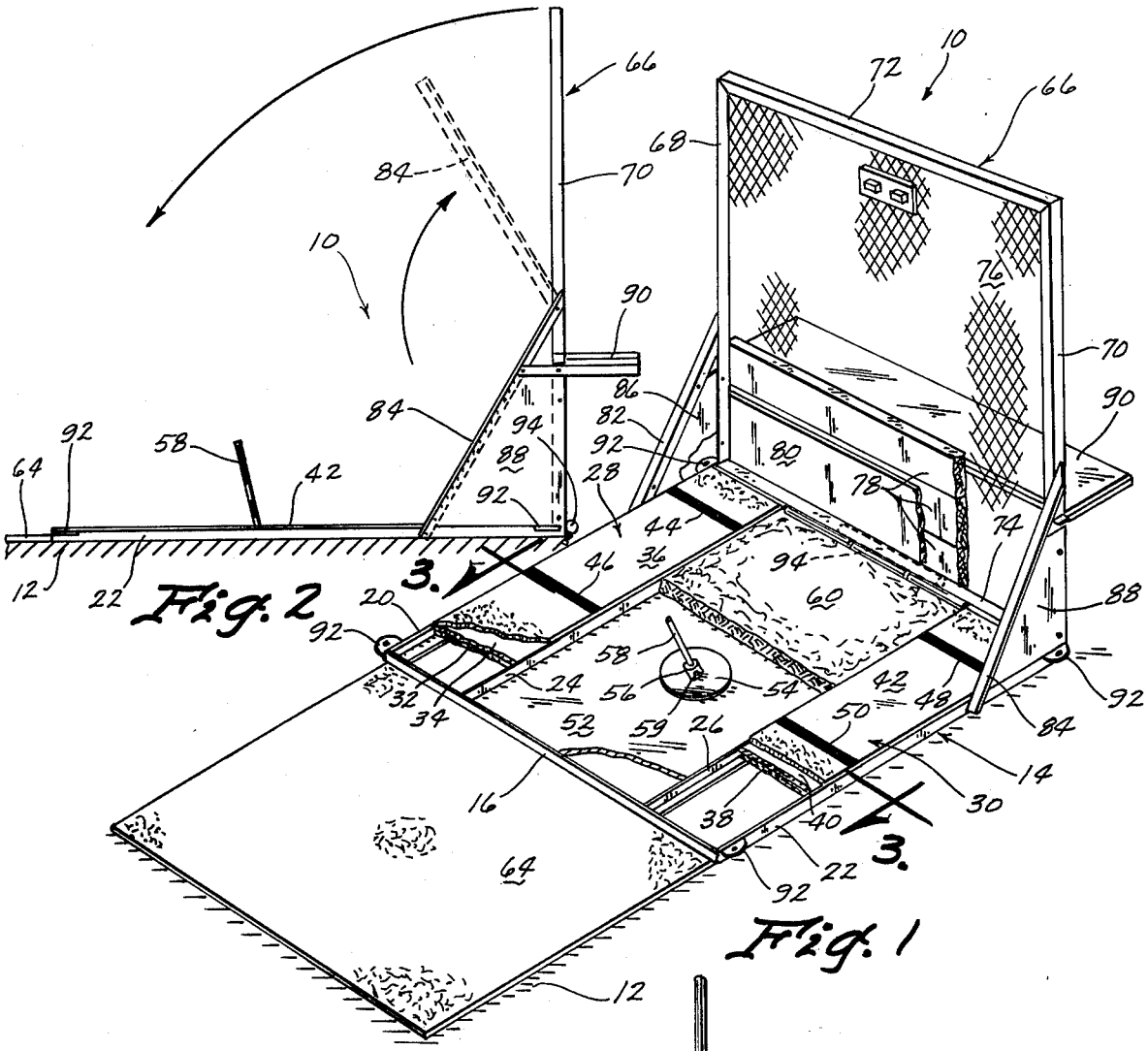
Fig. 2
Fig. 1
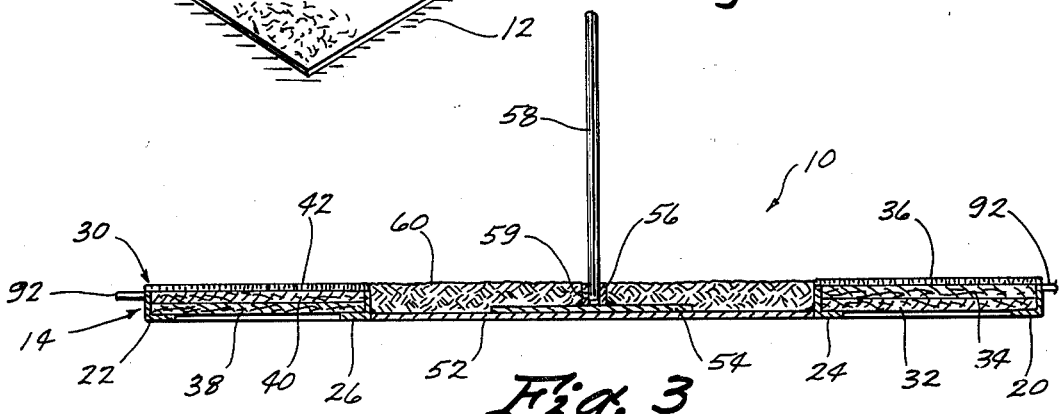
Fig. 3
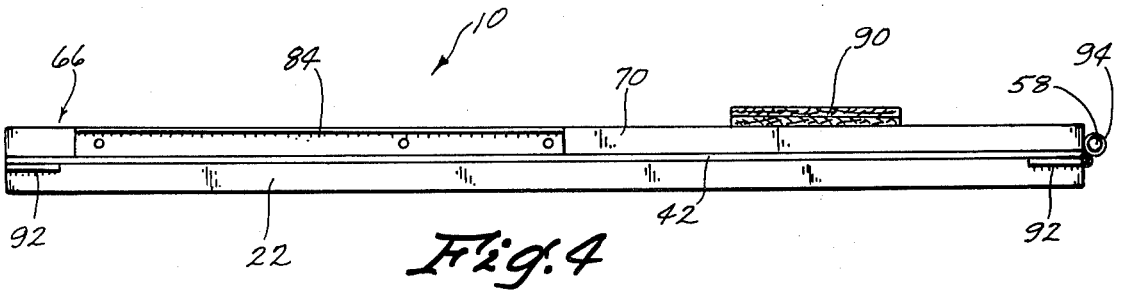
Fig. 4

PORTABLE FOLDING INDOOR-OUTDOOR HORSESHOE COURT

BACKGROUND OF THE INVENTION

This invention relates to a horseshoe court and more particularly to a portable folding horseshoe court which may be used either indoors or outdoors.

In typical horseshoe courts of the outdoor type, a pair of upstanding stakes are positioned a predetermined distance apart. In some installations, square boxes or frames extend around the pits. During the course of play, the horseshoes create sizable holes or pits in the ground around the stakes. It is clear that it would be difficult to provide indoor courts having the necessary realism of conventional courts and that it would be difficult to provide an indoor court which may be moved from one location to another.

Therefore, it is a principal object of the invention to provide a portable horseshoe court.

A still further object of the invention is to provide a folding portable indoor and outdoor horseshoe court.

A still further object of the invention is to provide a portable horseshoe court which may be easily moved from one location to another.

A still further object of the invention is to provide a portable horseshoe court having means to accommodate dirt therein around the stake.

A still further object of the invention is to provide a portable horseshoe court including means to prevent damage to the supporting surface.

A still further object of the invention is to provide a portable indoor and outdoor horseshoe court which is durable in use and refined in appearance.

These and other objects will be apparent to those skilled in the art.

BRIEF DESCRIPTION OF THE DRAWINGS

FIG. 1 is a front perspective view of the horseshoe court of this invention with portions thereof cut away to more fully illustrate the same:

FIG. 2 is a side view of the court with the broken lines illustrating one of the side braces being pivotally moved upwardly for transport;

FIG. 3 is an enlarged sectional view seen on lines 3—3 of FIG. 1; and FIG. 4 is a side view of the court illustrating the court in its folded transport position.

SUMMARY OF THE INVENTION

A portable horseshoe court is described which includes a horizontally disposed frame means having a pair of pitching platforms provided at the opposite sides thereof which extend between the forward and rearward ends thereof. Positioned in the center of the frame means is a pan which has dirt contained therein. An upstanding stake is positioned in the pan equi-distantly between the pitchers' platforms. A normally upstanding backstop has its lower end pivotally secured to the rearward end of the frame means and may be pivotally moved downwardly and forwardly with respect to the frame means so that the backstop substantially covers the frame means for transportation purposes.

DESCRIPTION OF THE PREFERRED EMBODIMENT

The court of this invention is referred to generally by the reference numeral 10 and is designed to be positioned on a supporting surface 12 such as a floor or the like. The numeral 14 refers to a horizontally disposed angle iron frame means including forward end 16, rearward end 18 and opposite sides 20 and 22. A pair of angle iron frame members 24 and 26 are secured to and extend between the forward and rearward ends 16 and 18 of the frame means 14. Frame members 24 and 26 are spaced approximately 17½ inches from the sides 20 and 22.

The numerals 28 and 30 refer to pitchers' or pitching platforms positioned at the sides of the court as illustrated in FIG. 1. Platform 28 is comprised of a pair of flat plywood members 32 and 34 glued into position and which are covered by a layer of artificial turf 36 which is glued in place. Likewise, platform 30 is comprised of a pair of flat plywood members 38 and 40 and a layer of artificial turf 42. Provided on the upper surface of the layer of artificial turf 36 is a pair of spaced-apart line markers 44 and 46. Likewise, a pair of line markers 48 and 50 are provided on the upper surface of member 42.

A metal pan 52 is secured to and extends between members 24 and 26 between the rearward and forward ends 18 and 16 respectively. Plate 54 is welded to pan 52 and has collar 56 welded thereto. The numeral 58 refers to a stake removably positioned in collar 56 and which extends upwardly therefrom. Stake 58 preferably has a one inch diameter and is 17 inches in length. Stake 58 is maintained in collar 56 by means of a set screw 59. The area between members 24 and 26 may be referred to as the pit area and is filled with dirt 60. Preferably, the forward end of member 16 is covered by a resilient member 62 such as a belt or the like to protect the same. Likewise, it is preferred that the supporting surface 12 be covered by a layer of cushioning or padding material 64 to protect the same.

A backstop generally indicated at 66 forms an important part of the invention not only during the actual playing the game but also during the transportation of the court. Backstop 66 includes an angle iron frame comprised of side members 68 and 70, upper member 72 and lower member 74. Member 74 is pivotally connected to the rearward end of the frame means 14 by any conventional means such as interconnecting sleeves or the like. The backstop 66 is provided with a steel net or fencing material 76 which extends thereacross as best seen in FIG. 1. Backstop 66 is also provided with a plurality of elongated wooden members 78 which are positioned at the lower forward end of the backstop. The lower forward portion of the member 78 is covered with a layer of cushioning or padding material 80.

Brace 82 has its upper end pivotally secured to side member 68 and has its lower end removably secured to side 20 by means of bolts or the like. Likewise, brace 84 has its upper end pivotally secured to side member 70 and has its lower end removably secured to side 22 by means of bolts or the like. The numerals 86 and 88 refer to removable inserts positioned as indicated to aid in preventing the shoes from leaving the court area. Members 86 and 88 are removably positioned by means of bolts or the like. An optional feature of the invention is the provision of a spectator bench 90 which is removably supported on the side members 68 and 70 by means of bolts or the like. A pickup element or member 92 is provided at the four corners of the frame means 14 to facilitate the entire assembly being raised from its supporting surface by means of a forklift or the like.

In use, the backstop 66 would normally be positioned as illustrated in FIG. 1. The players stand on the platforms 28 and 30 and would throw shoes to another court 10 positioned a predetermined distance apart. The provision of the various pads, cushions, and the backstop together with the fact that dirt is positioned around the stake 58 makes the court extremely realistic and very closely duplicates actual outdoor courts. When it is desired to move the court to a different location, the bench 90 is first removed by simply removing the bolts maintaining the same on the side members 68 and 70. The bolts maintaining members 86 and 88 in position are also removed at this time. The lower ends of braces 82 and 84 are loosened from their connections with the sides of frame member 14 and the braces are pivotally moved upwardly so as to be parallel with side members 68 and 70. Stake 58 is removed from collar 56 and placed in the tube or pipe 94 mounted at the rear of the court. The backstop 66 is then lowered from its upstanding position to a position wherein it extends over the platforms and the dirt within the pan. With the backstop 66 in the horizontal position as illustrated in FIG. 4, the court may be easily moved by attaching cable members or the like to the members 92 at the corners of the frame means. Thus, the court may be easily transported to a different location. The backstop 66 not only functions as a backstop during actual usage of the court but also serves to maintain the dirt in position in the pan as it is being moved from one location to another.

Thus it can be seen that a novel portable folding indoor and outdoor horseshoe court has been provided which accomplishes at least all of its stated objectives.

We claim:

1. A portable horseshoe court, comprising:

a horizontally disposed frame means including spaced-apart front and rear frame members having opposite ends, a first side frame member secured to and extending between said front and rear frame members at one end thereof, a second side frame member secured to and extending between said front and rear frame members at the other end thereof, a first intermediate frame member secured to and extending between said front and rear frame members inwardly of said first side frame member, a second intermediate frame member secured to and extending between said front and rear frame members inwardly of said second side frame member, a first pitcher's platform positioned between said first side frame member and said first intermediate frame member extending between said front and rear frame members, a second pitcher's platform positioned between said second side frame member and said second intermediate frame member extending between said front and rear frame members, a pan means extending between said intermediate side frame member and said front and rear frame members to define an area capable of receiving dirt, a stake extending upwardly from said pan means equidistantly between said platforms, a normally upstanding backstop means having upper and lower ends, said backstop means having its lower end pivotally connected to the rearward end of said frame means whereby said backstop means may be selectively pivoted from its normal upstanding position behind said frame means to a substantially horizontal transport position at least partially over said platforms and pan means, and means selectively maintaining said backstop means in its said upstanding position.

2. The court of claim 1 wherein said stake is removably secured to said pan means.

3. The court of claim 1 wherein a plate means is secured to said pan means, a collar mounted on said plate means, said stake being removably mounted in said collar.

4. The court of claim 1 wherein a protective material extends forwardly from the forward end of said frame means.

5. The court of claim 1 wherein said backstop means completely extends over said platforms and pan means when in its said transport position to maintain the dirt in said pan means when the court is being transported from one location to another.

* * * * *